United States Patent [19]

Viessmann

[11] 4,157,698

[45] Jun. 12, 1979

[54] WATER HEATING BOILER

[76] Inventor: Hans Viessmann, Im Hain, Battenberg, Eder, Fed. Rep. of Germany, 3559

[21] Appl. No.: 839,579

[22] Filed: Oct. 5, 1977

[30] Foreign Application Priority Data

Oct. 9, 1976 [DE] Fed. Rep. of Germany ..... 2645717

[51] Int. Cl.[2] ..... F22B 7/00; F23M 9/00

[52] U.S. Cl. ..... 122/136 R; 122/367 R; 110/326

[58] Field of Search ..... 122/136 R, 136 C, 149, 122/367 R, 367 C; 110/326

[56] References Cited

U.S. PATENT DOCUMENTS

| | | | |
|---|---|---|---|
| 2,123,444 | 7/1938 | Thibaudeau | 122/149 |
| 3,120,838 | 2/1964 | Mueller | 122/149 |
| 3,672,336 | 6/1972 | Joannes | 122/149 |
| 3,734,066 | 5/1973 | Scheyen | 122/136 |

*Primary Examiner*—Kenneth W. Sprague

*Attorney, Agent, or Firm*—Kurt Kelman

[57] ABSTRACT

A boiler comprises a water-carrying housing of sheet steel and a thin-walled cast iron casing arranged within the housing and having regions connected by condensate which are not machined. The casing includes a plurality of radial webs cast on the casing and supporting a sleeve defining a combustion chamber for the combustion of fuel. A guide chamber and a collecting chamber are defined by the casing adjacent opposite ends of the sleeve, the guide chamber being arranged to receive the combustion gases from the combustion chamber and the webs defining therebetween flow ducts connecting the guide and collecting chambers for conducting the combustion gases to the collecting chamber. The casing extends beyond the two end walls of the housing and the end walls form a liquid-tight connection with the casing. The webs extend into the guide and collecting chambers, the height of the web portions in the guide and collecting chambers not exceeding that of the web portions supporting the sleeve.

9 Claims, 3 Drawing Figures

WATER HEATING BOILER

The invention relates to a water heating boiler for the combustion of liquid or gaseous fuels, especially for lower capacity ranges, consisting of a water-carrying housing of sheet steel in which a cylindrical casing to receive the combustion chamber and the combustion gas flues is arranged with a guide chamber connected in front of it, the combustion chamber being surrounded by a plurality of flue ducts which are distributed over the entire circumference and are connected to a flue-gas collecting chamber with a flue-gas outlet.

Heating boilers of the type mentioned are known, for example, from Swiss Pat. No. 485,182 published Mar. 13, 1970. Although these known boilers may meet the set requirements regarding utilization of heat, practical implementation and economical production pose considerable problems, which is presumably why it has not been possible to introduce such boilers on the market.

Of interest in this respect are the embodiments of the patent, in which in a cylindrical jacket U-shaped or approximately U-shaped sheet-metal profiles are attached to the inner wall thereof and welded along their leg edges. Such boilers cannot be operated without difficulty over wide temperature ranges, hence especially not in low-temperature ranges of for example 30° to 60° C. due to the risks of corrosion associated therewith.

However attractive may be the notion of such a formation of of the fuel-gas flues in the boilers of the type mentioned, they do not, in the final analysis, meet the requirements for possible economically viable and practicable production, a long life which is likewise demanded and, finally, the requirements for optimum heat transmission conditions and favourable corrosion behaviour, allowance also having to be made for the fact that such boilers, if they are intended to be designed for lower capacity ranges of the order of approximately 10–25,000 kcal/h—such heating boilers are increasingly in demand at the present time when energy is being saved with improved thermal insulation of the rooms to be heated—require a disproportionately high production expenditure which cannot be balanced out by the somewhat reduced quantities of material because of smaller dimensions.

The problem of the invention is to improve water heating boilers of the prior art and of the type mentioned above in such a way that the requirements mentioned can be met at least approximately to an optimum degree, i.e., the intention is to create a water heating boiler, especially for lower capacities of the order of approximately 10–25,000 kcal/h, which can advantageously be manufactured economically without difficulty, which functionally meets heat transfer requirements and which can be operated also in low temperature ranges by controlling the condensates occuring in certain operating phases.

This problem is solved with a heating boiler according to the invention by the fact that the cylindrical casing is designed as a thin-walled cast-iron body which is not machined in regions in contact with condensates and which penetrates the front and rear sheet-steel housing walls cut to rectangular or annular shape and connected liquid-tight to the cast-iron body. Radially inwardly directed webs are cast on the inner face of the cast-iron body in the region of the combustion chamber and support the combustion chamber sleeve, limiting the flue ducts laterally and extending at maximum to an equal height also over the faces of the guide and flue-gas collecting chambers.

In this solution according to the invention the favourable behaviourial properties of unmachined cast iron towards attack from condensates, on the one hand, and the good processability of sheet steel, on the other, are combined, formation of the flue ducts being included in the formation of the cylindrical casing from cast iron and, consequently, no welding work at all being needed in this region. To create good heat transfer conditions from the combustion chamber sleeve, merely to be pushed in, to the webs, the webs can advantageously be provided with narrow crossbars which can also be machine-cut directly in their bearing faces for fitting of the combustion chamber sleeve, as there the webs never assume temperatures critical for condensates.

As the webs themselves are not water-cooled, but the wall of the cylindrical casing from which the cast-on webs project is water-cooled, the webs are advantageously provided with transverse slots so that different heat stresses can be allowed for.

For the liquid-tight inclusion of the cylindrical casing in the outer sheet-steel housing the casing is advantageously designed so that it is connected liquid-tight at its outer end regions to sheet-steel rings which are each cast in a collar of the chamber.

Likewise with regard to varying thermal expansion behaviour the rings can be provided with an annular attenuation of the wall thickness. The rings are, together with the casing—if the rings do not themselves directly form the front and rear walls—inserted into correspondingly large openings in the front and rear wall of the boiler housing and welded thereto. To make the casing provided with the rings slide in from one side effectively, the rings can, if the outer housing is already finished, be designed with different outside diameters. If the rings themselves form the front and rear walls of the outer housing, they need only be surrounded by a cylindrical sheet-steel sleeve and welded.

The water heating boiler according to the invention is explained in detail below by reference to the diagrammatic representation of an embodiment.

Figure 1:
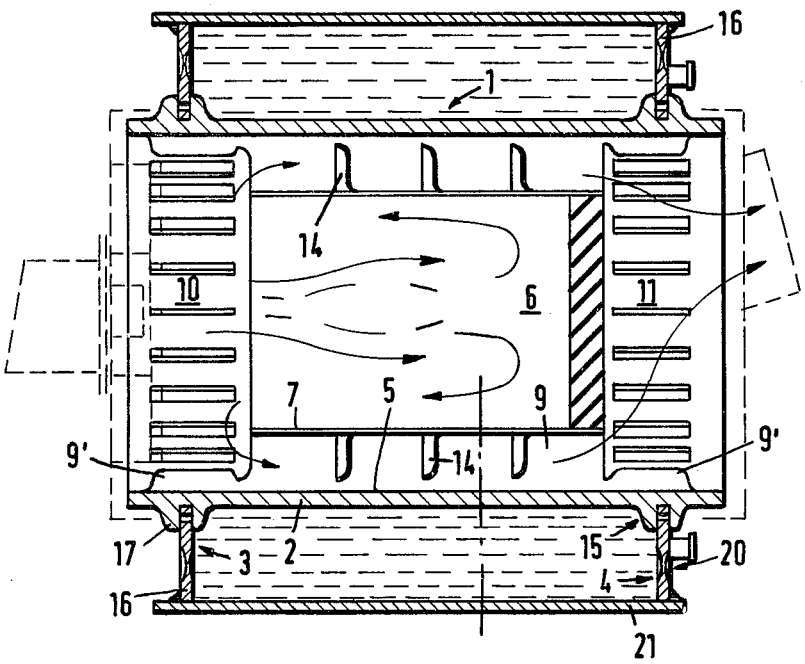
FIG. 1 is a longitudinal section through the water heating boiler.

As shown in FIG. 1, the entire "inner boiler 1" merely consists of the cylindrical cast iron casing 2 which includes webs 9 cast on and provided with slots 14. The radially extending webs define therebetween flue ducts 8 which are limited radially outwards by the inner faces 5 of casing 2 and radially inwards by the combustion chamber sleeve 7 of fine steel, for example, which is pushed into the inner boiler. The webs 9 are provided at their free ends 12 with narrow cross bars 13, the cross bar faces 13' being machined for good fitting of the combustion chamber sleeve 7 surrounding combustion chamber 6. The resulting damage of the skin highly resistant to condensate is not critical in this region, because here the webs always become hotter than 60° C. The webs 9' in the guide chamber 10 and the flue-gas collecting chamber 11 are not machined, however, and have a height of only approximately 3 to 10 mm; they are even thinner than the webs 9 and certainly become hotter than the outer cooled peripheral walls in these regions of the chamber. By this arrangement of the webs 9' possible condensate in the bottom region is therefore reduced to a minimum.

Figure 2:
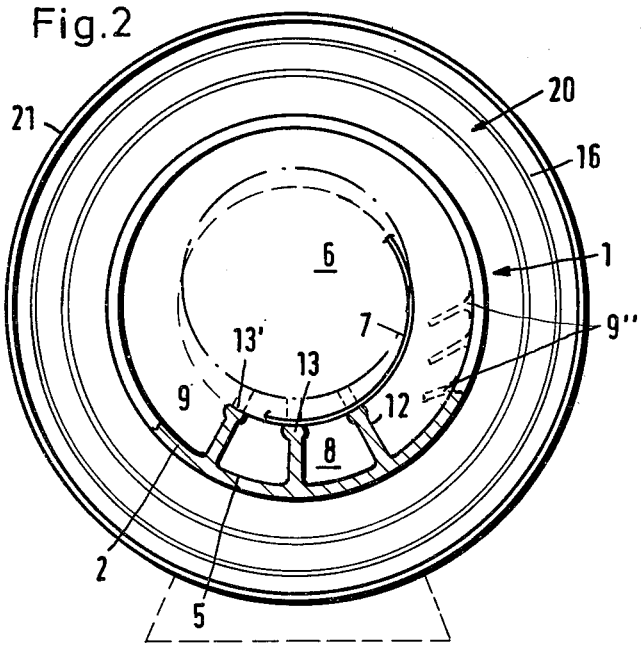
FIG. 2 is a partial transverse section through the water heating boiler according to FIG. 1.

Production by casting of the cylindrical casing 2 with the webs 9 enables the heights of the webs to be varied so that the combustion chamber sleeve 7 to be inserted is displaced eccentrically upwards, as a result of which a favourable distribution of the gas content in the flues is obtained due to the draught resistances changed thereby, as shown in FIG. 2 by broken lines. Nor is there any difficulty in arranging, as appropriate, the webs 9' closer to one another in the bottom regions of the guide chamber 10 and the collecting chamber 11, as a result of which the flue gases are kept even further from the walls which are cold there.

Figure 3:
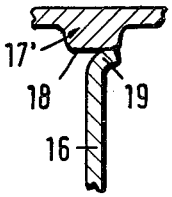
FIG. 3 is a section of a structural detail.

As shown in FIG. 1, the junction of cast iron and sheet-steel, critical per se, is solved very simply by the fact that sheet steel rings 16 which preferably themselves form the front and rear walls 3,4 of the boiler housing and are in this case welded directly to a cylindrical sheet-steel outer housing 21 are cast in collars 17 at the outer end regions 15 of casing 2 or are shrunk liquid-tight onto machined peripheral faces 18 of collars 17' (FIG. 3), for which rims 19 are bent outwardly so that a kind of shrink-fit flange is obtained. To allow for the different thermal expansion behaviour of cast iron and sheet steel, the rings 16 are provided with an annular wall thickness attenuation 20.

To the extent that on this water heating boiler any machine-cutting work destroying the skin highly resistant to condensates has to be carried out on the cast iron body 2, these regions are on parts which are non-critical in this respect.

As shown by broken lines in FIG. 2, a further advantageous embodiment involves arranging the webs 9" in the guide chamber 10 and the flue-gas collecting chamber 11 in the two lower quadrants to be inclined downwards so that deposits of condensate run to the free pointed edges of the webs, i.e., where the webs are hottest, as a result of which reliable evaporation of the condensate is achieved and the accumulation of condensate in the bottom settling creases of the webs is prevented. The webs 9" can be kept larger in height than is shown for example in FIG. 1.

The circular shape of the entire water heating boiler shown in FIG. 1 is not compulsory, i.e., the water heating boiler can also have a rectangular outer shape, although cast-iron body 2 remain cylindrical.

What is claimed is:

1. A water heating boiler comprising (a) a water-carrying housing including two end walls, the housing being of sheet steel, (b) a thin-walled cylindrical casing of cast iron arranged within the housing, the casing having an inner and an outer surface, and regions contacted by condensate and not machined, and the casing including (1) a plurality of webs cast on the casing and extending radially inwardly from the inner surface thereof and about its entire circumference, and (c) a sleeve supported by the webs and defining a combustion chamber for the combustion of a fuel to form combustion gases, (1) the casing defining adjacent one end of the sleeve a guide chamber and adjacent an opposite end of the sleeve a combustion gas collecting chamber, the guide chamber being arranged to receive the combustion gases from the combustion chamber, (2) the webs defining therebetween flue ducts connecting the guide and collecting chambers, the flue ducts conducting the combustion gases to the collecting chamber, (3) the casing extending beyond the two end walls and the end walls forming a liquid-tight connection with the outer surface of the casing, and (4) the webs extending into the guide and collecting chambers, the height of the web portions in the guide and collecting chambers not exceeding that of the web portions supporting the sleeve.

2. The water heating boiler of claim 1, wherein the end walls have bent-over rims shrunk-fit to the outer casing surface to form the liquid-tight connection.

3. The water heating boiler of claim 1, wherein the web portions supporting the sleeve have narrow cross bars on their free ends.

4. The water heating boiler of claim 1, wherein the casing is machined exclusively in the regions where the webs support the sleeve.

5. The water heating boiler of claim 1, wherein the webs define transverse slots spaced from each other.

6. The water heating boiler of claim 1, wherein the casing collars cast on the outer surface of the casing adjacent respective ends thereof, and the end walls are sheet steel rings forming the liquid-tight connection with the collars.

7. The water heating boiler of claim 6, wherein the sheet steel rings have an annular wall thickness attenuation.

8. The water heating boiler of claim 1, wherein the sleeve is eccentrically upwardly displaced in relation to the axis of the cylindrical casing.

9. The water heating boiler of claim 1, further comprising downwardly inclined webs arranged in the two bottom quadrants of the guide and collecting chambers.

* * * * *